United States Patent [19]

Miller et al.

[11] 4,392,665

[45] Jul. 12, 1983

[54] BOAT DOLLY

[76] Inventors: Toby D. Miller, 616 S. Lee St., Garrett, Ind. 46738; James A. Miller, 204 E. Diamond, Kendallville, Ind. 46755

[21] Appl. No.: 254,454

[22] Filed: Apr. 15, 1981

[51] Int. Cl.[3] ..... B60P 3/10

[52] U.S. Cl. ..... 280/414.2; 114/344; 280/47.13 B

[58] Field of Search ..... 280/414.1, 414.2, 63, 280/47.13 B; 114/344

[56] References Cited

U.S. PATENT DOCUMENTS

| | | | |
|---|---|---|---|
| 2,540,279 | 2/1951 | Mosier | 280/414.2 |
| 2,551,040 | 5/1951 | Newell | 280/47.13 B |
| 3,361,441 | 1/1968 | McRae | 280/414.2 |
| 3,455,473 | 7/1969 | Parker | 280/414.1 |
| 3,462,781 | 8/1969 | Olvera | 280/47.13 B |
| 4,214,774 | 7/1980 | Kluge | 280/47.13 B |

*Primary Examiner*—Joseph F. Peters, Jr.
*Assistant Examiner*—Donn McGiehan
*Attorney, Agent, or Firm*—George A. Gust

[57] ABSTRACT

A boat dolly for supporting the stern of a boat. The bow of the boat rests on a pair of longitudinally disposed and transversely spaced-apart ropes that are tied to the frame of the boat dolly. The bow of the boat is supported and both the boat and boat dolly are propelled by applying manual force to the ropes. The boat dolly includes transversely adjustable wheels, transversely adjustable transom clamps, vertically adjustable transom clamps, self-adjusting hull-receiving rails, and provisions for folding to achieve compact storage.

10 Claims, 11 Drawing Figures

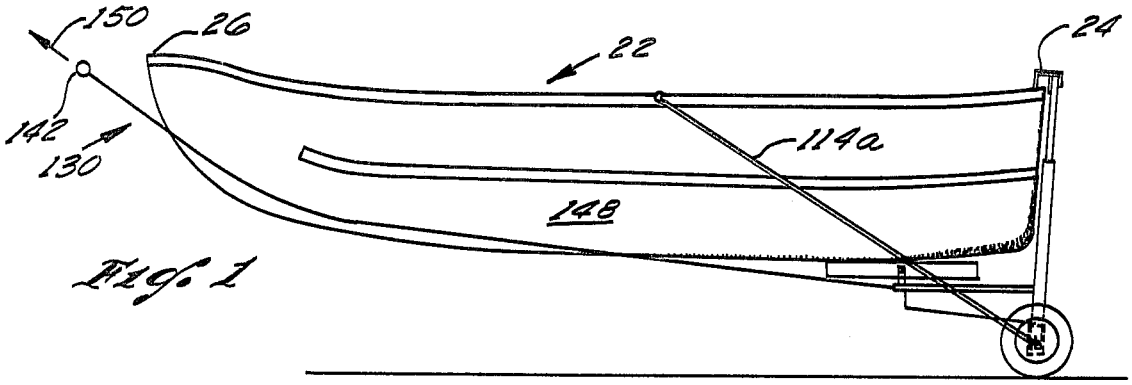
Fig. 1
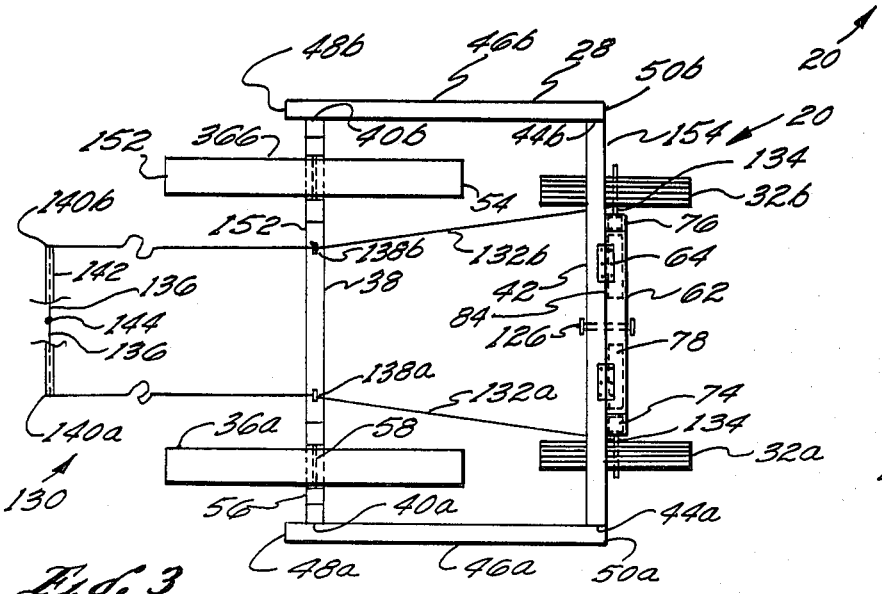
Fig. 3
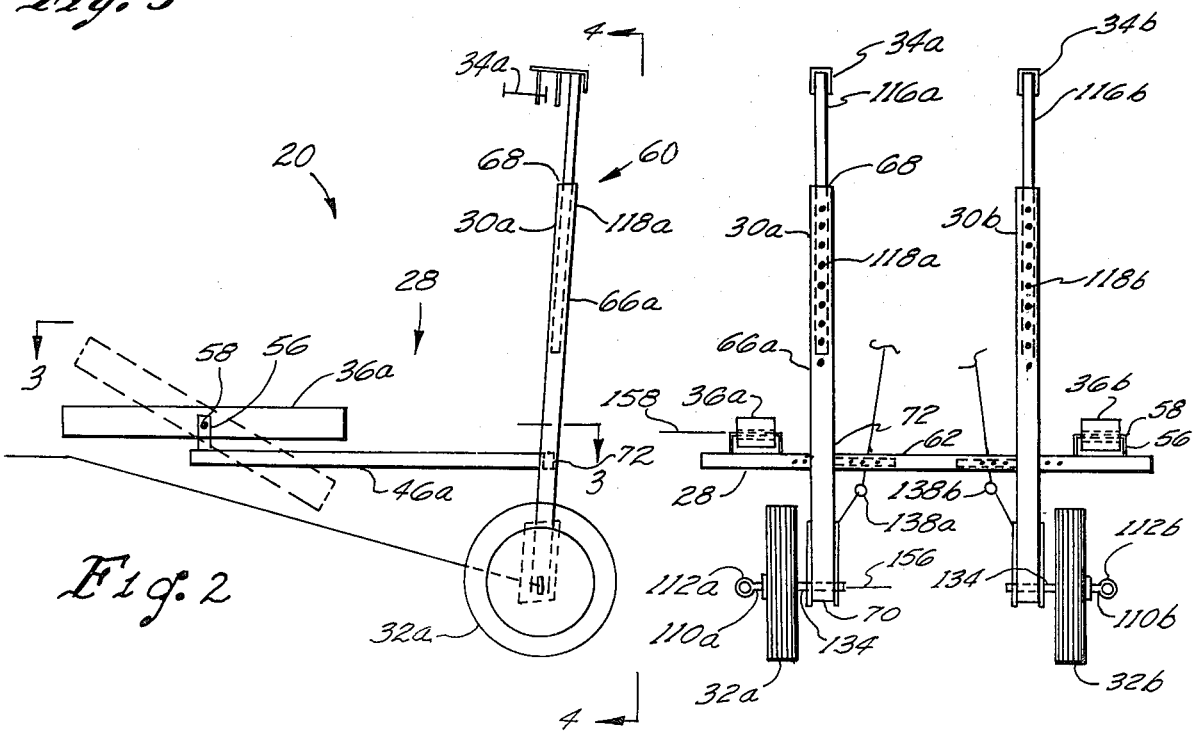
Fig. 2
Fig. 4

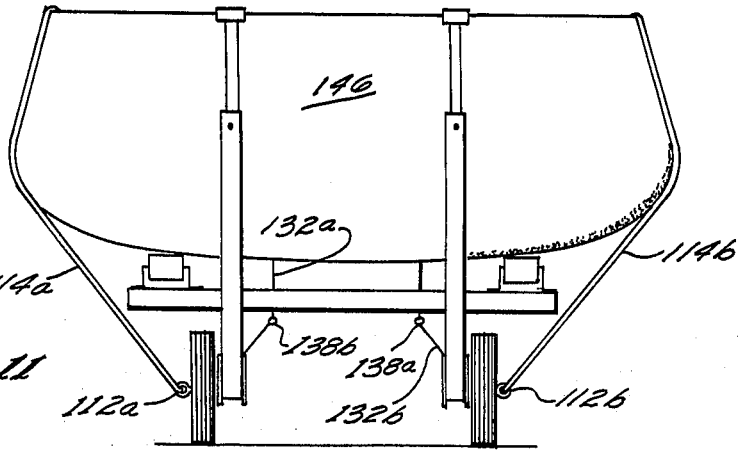
Fig. 11
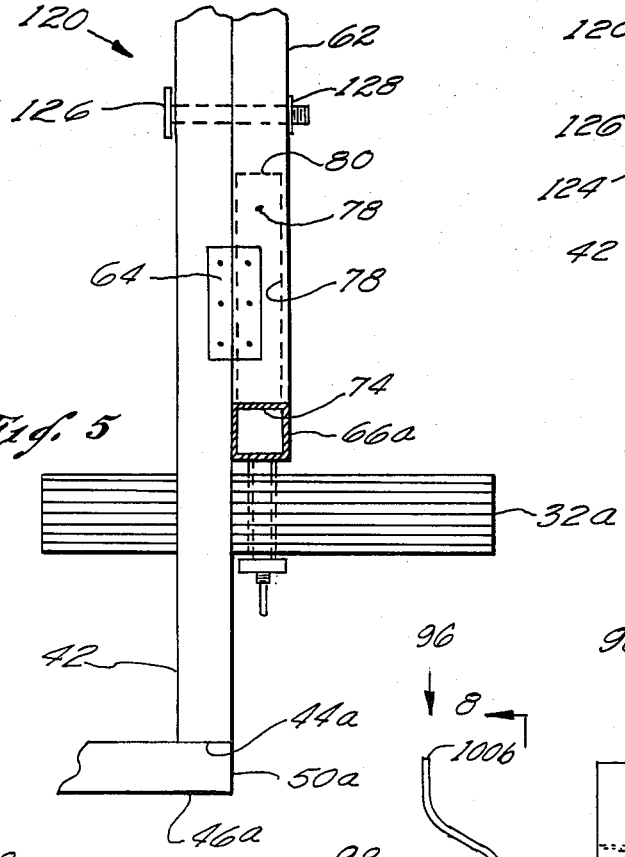
Fig. 5
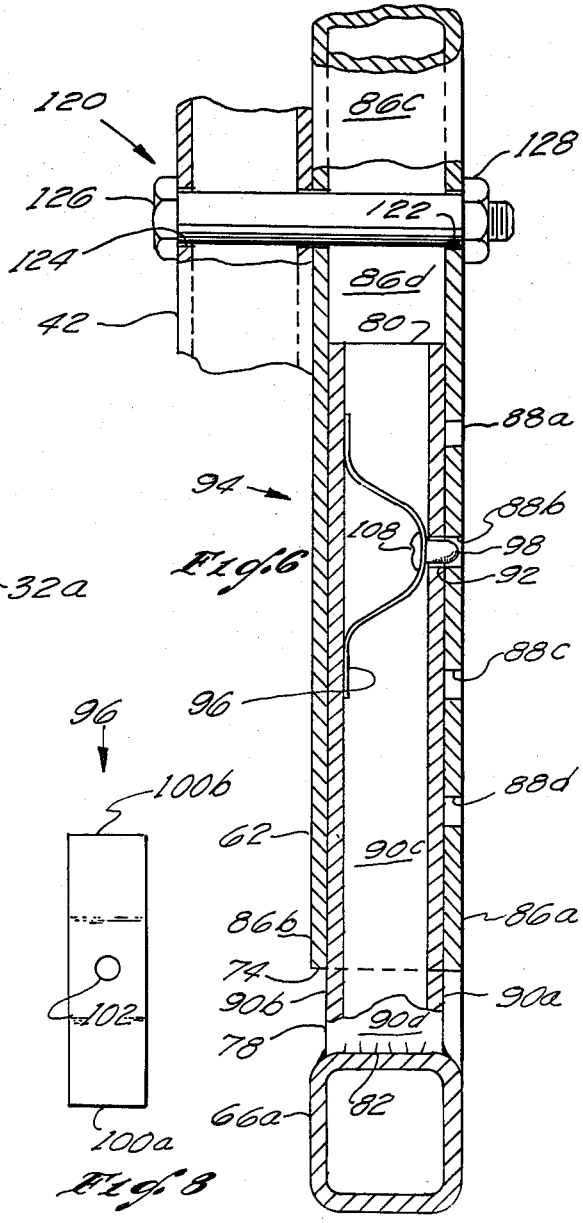
Fig. 6
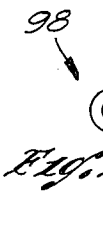
Fig. 10
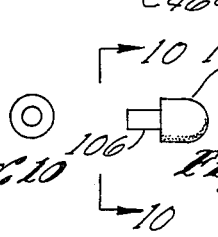
Fig. 9
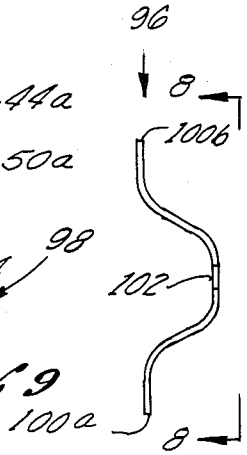
Fig. 7
Fig. 8

BOAT DOLLY

BACKGROUND OF THE INVENTION

1. Field of the Invention

The present invention relates generally to boat trailers, and more particularly to boat dollies for manually transporting a boat.

2. Description of the Prior Art

The prior art includes Olvera, U.S. Pat. No. 3,462,781. Olvera discloses a boat dolly that is attached to the transom of a boat by drilling through the transom and attaching a hinged bracket with bolts. The dolly remains on the boat while the boat is in the water. The wheels of the dolly extend downwardly into the water but are free to move rearwardly if they come into contact with a submerged object. Newell, U.S. Pat. No. 2,551,040 discloses a two-wheel dolly that is attached to the transom of a boat by means of a clamp or to the motor bracket. Kluge, U.S. Pat. No. 4,214,774 discloses a boat dolly that includes a disassemblable tongue that may be disjointed for storage. The tongue provides support for the bow end of the boat and also a handle for manually supporting the bow end and for transporting the boat. This patent also provides for transversely folding the wheels along the transverse support member.

SUMMARY OF THE INVENTION

In accordance with the broader aspects of this invention, there is provided a boat dolly for manually transporting a boat. The boat dolly includes a cradle frame for receiving the boat near one end thereof, a pair of transversely spaced-apart wheels being mounted to the cradle frame, and a pair of ropes each having one end thereof fastened to the cradle fame and the other end thereof fastened to an elongated handle.

The ropes provide flexible supporting and propelling means for supporting one end of the boat and for propelling both the boat and the boat dolly in response to force manually applied to the elongated handle.

In a preferred embodiment, the boat dolly includes a pair of rear struts that are pivotally mounted to the cradle frame. The rear struts may be folded forward against the cradle frame for storage of the boat dolly and are locked in an upright position when the boat dolly is in use. The rear struts are adjustable in height and each include a transom clamp attached to the top thereof for attaching to the transom of the boat and thereby securing the boat to the boat trailer.

Further, in the preferred embodiment, the boat dolly is adaptable for use on various size boats by providing for rapid adjustment of the space between the wheels, the space between the rear struts, and the height of the transon clamps.

It is an object of this invention to provide a boat dolly that is simple in design, of low cost and easy to use.

It is another object to provide a boat dolly which may be collapsed into a small package for storage.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

In the drawings,

FIG. 1 is a side elevation of the boat dolly with a boat mounted thereon;

FIG. 2 is a side elevation of the boat dolly of FIG. 1;

FIG. 3 is a cross-section of the boat dolly of FIG. 2 taken substantially as shown by section line 3—3 of FIG. 2;

FIG. 4 is a rear elevation of the boat dolly of FIG. 2 taken substantially as shown by view line 4—4 of FIG. 2;

FIG. 5 is a partial and enlarged top view of the boat dolly of FIG. 3, taken substantially as shown in FIG. 3;

FIG. 6 is a partial and further enlarged longitudinal section of the adjustable transverse beam assembly of the boat dolly;

FIG. 7 is a side elevation of the leaf spring of the detent mechanism of FIG. 6;

FIG. 8 is a top view of the leaf spring of FIG. 7;

FIG. 9 is a side view of the detent pin of FIG. 6;

FIG. 10 is an end view of the detent pin of FIG. 9; and

FIG. 11 is a rear elevation of the boat dolly with a boat mounted thereon as in FIG. 1.

DESCRIPTION OF THE PREFERRED EMBODIMENT

Referring now to FIGS. 1–4, a boat dolly 20 for a boat 22 having a stern end 24 and a bow end 26, includes a cradle frame 28, rear upright struts 30*a* and 30*b*, wheels 32*a* and 32*b*, transom clamps 34*a* and 34*b* and hull-receiving rails 36*a* and 36*b*.

Referring to FIG. 3, the cradle frame 28 includes a first transverse rectangular steel tube 38 having ends 40*a* and 40*b*, a second transverse rectangular steel tube 42 having ends 44*a* and 44*b*, and longitudinally disposed rectangular steel tubes 46*a* and 46*b* that include forward ends 48*a* and 48*b* and rearward ends 50*a* and 50*b*. The tubes 46*a* and 46*b* are welded or otherwise secured to the ends 40*a*, 40*b*, 44*a*, and 44*b* of the transversely disposed tubes 38 and 42, with the tube 38 being proximal to the forward ends 48*a* and 48*b* and with the tube 42 being proximal to the rearward ends 50*a* and 50*b*.

Referring to FIGS. 2–5, the hull-receiving rails 36*a* and 36*b* each include a forward end 52 and a rearward end 54; and the hull-receiving rails 36*a* and 36*b* are pivotally attached to the transversely disposed rectangular tube 38 by brackets 56 and transversely diposed pins 58.

A rear strut means 60, which includes the rear struts 30*a* and 30*b*, also includes a transverse rectangular steel tube or hinge bar 62 adjacent and parallel to tube 42 which is hingedly attached to the tube 42 by a pair of hinges 64 for pivotal movement about an axis parallel to the axis of bar 62.

The rear struts 30*a* and 30*b* respectively include first rectangular steel or lower strut tubes 66*a* and 66*b*. Each of these lower strut tubes 66*a* and 66*b* includes an upper end 68, a lower end 70 and an intermediate portion 72. The first tubular bar 62 includes a first end 74 and a second end 76. A second hollow rectangular steel bar or stub 78 includes an inner end 80 and an outer end 82. The outer end 82 is welded or otherwise attached to the lower strut tube 66*a* at the intermediate portion 72 thereof as shown in FIG. 4. In like manner, the lower strut tube 66*b* is attached to a third hollow rectangular bar or stub 84 in the same manner as the lower strut tube 66a is attached to the second tubular bar 78. The stubs 78 and 84 are telescopically inserted into respective first and second ends 74 and 76 of the first tubular bar 62, and so the strut tubes 66a and 66b are transversely adjustable by changing the relative telescopic positions of the stubs 78 and 84 within the first tubular bar 62.

Referring now to FIG. 6, the first tubular bar 62 includes side walls 86a–86d. The tubular bar 62 also includes transversely disposed pin holes 88a–88d which open through the side wall 86a. The stub 78 includes side walls 90a–90d, and a pin hole 92 which extends through the side wall 90a.

A leaf spring and detent pin assembly 94, which includes a leaf spring 96 and a detent pin 98, cooperates with the holes 88a–88d and 92 to provide a detent means for locking, unlocking, telescopically adjusting, and relocking the tubular bar 62 and stub 78 in relative telescopic positions.

Referring now to FIGS. 6–10, the leaf spring 96 includes ends 100a and 100b and a hole 102 that is disposed intermediate of the ends 100a and 100b. The detent pin 98 includes a larger diameter portion 104 and a reduced diameter portion 106. The reduced diameter portion 106 is sized for insertion into the hole 102 of the leaf spring 96 and to be swaged to provide a head 108 as shown in FIG. 6.

The leaf spring 96 is formed substantially as shown in FIG. 7; and the ends 100a and 100b resiliently press against the side wall 90b of the tube 78, thereby resiliently forcing the detent pin 98 outward through the hole 92 and into engagement with a selected one of the holes 88a–88d.

Referring now to FIGS. 2–4, the wheels 32a and 32b are attached to the lower ends 70 of respective lower strut tubes 66a and 66b by axles 110a and 110b. Eyebolts 112a and 112b are attached to respective axles 110a and 110b for use in attaching flexible tie-down elements or tie-down straps 114a and 114b, as shown in FIGS. 1 and 11. Each of the tie-down straps, 114a and 114b, extends from the respective eyebolts 112a or 112b to an oar lock (not shown) of the boat 22.

The rear struts 30a and 30b include, in addition to the first or lower strut tubes 66a and 66b, second or upper strut tubes 116a and 116b which are rectangular in shape and telescopically inserted into respective ones of the lower strut tubes 66a and 66b. The struts 30a and 30b also include a detent means 118a and 118b. Each of the detent means 118a and 118b includes transversely disposed holes, leaf springs, and detent pins such as have been previously described in conjunction with FIGS. 6–10 and which will be clearly understood by the aforementioned description.

Referring now to FIGS. 3, 5 and 6, the boat dolly 20 includes fold lock means 120, comprising a first hole 122 through the tubular bar 62, a second hole 124 that extends through the tube 42, a lock bolt 126 inserted through the holes 122 and 124, and a nut 128.

Referring now to FIGS. 1, 3 and 4, the boat dolly 20 includes a flexible supporting and propelling means 130. The flexible supporting and propelling means 130 includes first and second ropes or flexible tension elements 132a and 132b, each having first ends 134 and second ends 136. The first ends 134 of the ropes 132a and 132b are attached to respective ones of the axles 110a and 110b as seen in FIG. 4.

The ropes 132a and 132b are then guidingly restrained by respective eyebolts 138a and 138b attached to the tube 38. The eyebolts 138a and 138b provide means for transversely spacing the ropes 132a and 132b, the distance between the ropes 132a and 132b preferably being about 20 centimeters. The ends 136 of the ropes 132a and 132b may be attached to respective ends 140a or 140b of an elongated handle 142; or the ropes 132a and 132b may be continuous or interconnected as shown by a knot 144 in which case the handle 142 is hollow and encases the ends 136. The elongated handle 142 is preferably approximately 20 centimeters long; and the handle 142 provides a means for spacing apart the ropes 132a and 132b near the ends 136 thereof.

In use, the stern end 24 of the boat 22 is loaded upon the hull-receiving rails 36a and 36b and transom clamps 34a and 34b are clamped to a transom 146 of the boat 22. The tie-down straps 114a and 114b are secured to the boat 22; and the ropes 132a and 132b are positioned under a hull 148. A pulling force on the handle 142 in the direction of an arrow 150 is effective both to support the bow end 26 of the boat 22, and to propel the boat 22 and the boat dolly 20.

For storage, the bolt 126 is removed from the holes 122 and 124; and the struts 30a and 30b are folded forwardly so that the struts 30a and 30b are substantially parallel to the frame tubes 46a and 46b with the wheels 32a and 32b extending rearwardly.

In summary, the present invention provides a boat dolly that comprises a cradle frame 28 having a front portion 152 and a rear portion 154 as shown in FIG. 3, a pair of transversely spaced-apart wheels 32a and 32b operatively mounted to the cradle frame 28 for rotation about a single transverse axis 156, and flexible supporting and propelling means 130, comprising a flexible tension element 132a, 132b for both supporting the bow end 26 of the boat and pulling both the boat 22 and the boat dolly 20 in response to a pulling force manually applied to the flexible tension element 132a.

The wheels 32a and 32b are adjustable along the single transverse axis 156 of virtue of the struts 30a and 30b being transversely adjustable.

The boat dolly 20 includes means for securing the boat 22 to the boat dolly 20 by the transom clamps 34a and 34b and also the flexible tie-down elements 114a and 114b.

The boat dolly further provides means for adjusting the height of the transom clamps 34a and 34b by virtue of the telescopic arrangement of the strut tubes 66a and 66b with respective ones of the strut tubes 116a and 116b.

The boat dolly 20 provides self-adjusting rail means, comprising the hull-receiving rails 36a and 36b that are pivotally mounted to the tube 38 for pivotal movement about a second single horizontal axis 158, as shown in FIG. 4, that is parallel to the axis 156.

Finally, the present invention provides an extendable tube assembly that includes the tubes 62 and 78 and detent means. The detent means includes the transversely disposed holes 88a–88d and 92 and the leaf spring and detent pin assembly 94. Also included are extendable tube assemblies in the form of the tubes 62 and 84, the tubes 66a and 116a, and the tubes 66b and 116b, all of which utilize the leaf spring and detent assembly 94 as clearly shown in FIG. 6.

The present invention provides advantages over all of the prior art by providing a flexible supporting and propelling means for supporting the forward end of the boat and for propelling both the boat and the boat dolly as a unit.

Means are provided for folding the rear struts of the boat dolly forward for storage and for locking the rear struts in the working position. Facile adjustment of the height of the transom clamps for adaptation to different size boats is provided for raising the transom clamps out of the way while loading the boat onto the dolly, and for lowering the transom clamps to engage the inside of the transom. Convenient adjustment of the transverse spacing between the wheel is provided. Adjustable spacing between the transom clamps is provided making the boat dolly readily adjustable to different size boats. Elongated and longitudinally disposed hull-receiving rails are provided that adjustably conform to the hull of a boat. The length of these hull-receiving rails effectively precludes the danger of a boat falling off of the boat dolly during loading onto the boat dolly, and the self-aligning feature protects the hull of the boat from damage.

Finally, the present invention provides a simple and durable design for the detent pins that are used to provide instantaneous adjustment of wheel spacing, transom clamp spacing, and transom clamp height.

While there have been described above the principles of this invention in connection with specific apparatus, it is to be clearly understood that this description is made only by way of example and not as a limitation to the scope of the invention.

What is claimed is:

1. A boat dolly having first and second ends comprising:

cradle frame means for receiving and supporting the stern portion of a boat, a pair of transversely spaced-apart wheels operatively mounted to said cradle frame means;

flexible supporting and propelling means, comprising two transversely spaced apart ropes secured at one end to said cradle frame means and extending longitudinally forwardly of the underside of the hull of a boat on said frame means for both supporting the bow portion of said boat and propelling said boat and said boat dolly as a unit in response to a pulling force exerted on the other end thereof, said frame means having front and rear portions and including two spaced longitudinal frame members and two spaced cross frame members secured thereto, transversely spaced eyelets depending from said frame means and receiving said ropes therethrough thereby spacing said ropes apart, an upright strut device hingedly mounted on the rear portion of said frame means for pivotal movement about a transverse axis between first and second positions, in said first position said strut device being upright and in said second position said strut device being folded onto said frame means, said strut device including two elongated substantially parallel and spaced apart struts each being provided with a laterally extending elongated stub, a hinge bar hingedly mounted on the rear portion of said frame means for swinging movement about a transverse axis parallel to the axis of said hinge bar, said hinge bar being hollow and telescopically receiving said stubs within the opposite end portions thereof, means for releaseably locking said stubs and hinge bar together in adjusted telescoped position; and said wheels being carried on the lower ends of said struts, respectively.

2. The boat dolly of claim 1 wherein said frame means includes two elongated rails which are spaced apart and parallel and extend longitudinally thereof, said rails each being pivotally mounted on the upper side of said frame means intermediate the ends thereof for rocking movement, said locking means including spring detents carried within said stubs and engageable with longitudinally spaced holes in said hinge bar, said ropes being connected at said one end to the lower ends of said struts, respectively.

3. The boat dolly of claim 2 wherein said struts are adjustable in length and in the upper ends thereof carry transom clamps, said eyelets being mounted on the forwardmost cross member, said hinge bar being hingedly mounted on the rearmost cross member, said rails being mounted on the forwardmost cross member, and a threaded fastener passing through said rearmost cross member and said hinge bar for locking said strut device in said first position.

4. A boat dolly for manually transporting a boat having first and second ends, which boat dolly comprises:

cradle frame means, having front and rear edges, for receiving and supporting a boat proximal to one of said ends thereof;

rear strut means for providing an upper portion that extends upwardly from said cradle frame means and thereby prevents one end of a boat from moving rearwardly, and for providing a lower portion that extends downwardly below said cradle frame means;

means for pivotally attaching said rear strut means to said cradle frame means proximal to said rear edge, and for permitting said upper portion to be folded toward said cradle frame means;

a pair of wheels being transversely spaced apart, being disposed for rotation about a single transverse axis that is disposed below said cradle frame means, and being attached to said lower portion of said rear strut means; and means for locking said rear strut means with said upper portion disposed upwardly from said cradle frame means and with said lower portion disposed downwardly from said cradle frame means, said rear strut means and said means for pivotally attaching said rear strut means to said cradle frame means comprising a rectangular steel tube that is horizontally and transversely disposed and is pivotally attached to said cradle frame means;

said means for locking comprising a threaded fastener for securing said steel tube to said frame means.

5. A boat dolly as claimed in claim 4 including a flexible strand device secured at one end to said cradle frame means and extendable forwardly for engagement with the hull of a boat on said cradle frame means.

6. A boat dolly as claimed in claim 5 in which said flexible strand device comprises two ropes which are spaced apart and extending substantially parallel.

7. A boat dolly as claimed in claim 4 in which said rear strut means and said pivotal attaching means comprises:

a first upright strut having a first elongated stub secured at one end to said strut intermediate the ends and to extend laterally thereof, a second upright strut like the first and having a second elongated stub secured at one end to said second strut intermediate the ends and to extend laterally thereof, a steel tube telescopically receiving said stubs within the opposite end portions thereof, said steel tube being pivotally connected to said frame means to extend transversely thereof and for pivotal movement about a horizontal axis parallel to the axis of said tube, and means for releaseably locking said stubs and tube in adjusted position.

8. A boat dolly as claimed in claim 7 in which said stubs and tube are of rectangular cross-section and said stubs are hollow, said means for releaseably locking includes two spring detents; each detent including a pin received within a hole in a wall of a stub and one of a plurality of longitudinally spaced holes in a wall of said tube, a leaf spring within the stub and carrying said pin, said leaf spring resiliently engaging opposite walls of the respective stub thereby yieldably urging said pin into locked position in said holes as aforesaid; and first and second transom clamps on the upper ends of said struts.

9. A boat dolly as claimed in claim 8 in which said rear strut means comprises first and second strut tubes that are telescopically engaged, and means for locking said strut tubes in different telescoping positions.

10. A boat dolly as claimed in claim 4 in which said cradle frame means comprises a frame having forward and rearward cross-members, and a pair of spaced-apart and longitudinally disposed hull-receiving rails each having first and second ends and each being pivotally attached to said forward cross-member at a point intermediate of said ends and about an axis that is substantially parallel to said single transverse axis.

* * * * *